US011696085B2

(12) United States Patent
Mate et al.

(10) Patent No.: US 11,696,085 B2
(45) Date of Patent: Jul. 4, 2023

(54) APPARATUS, METHOD AND COMPUTER PROGRAM FOR PROVIDING NOTIFICATIONS

(71) Applicant: Nokia Technologies Oy, Espoo (FI)

(72) Inventors: Sujeet Shyamsundar Mate, Tampere (FI); Arto Lehtiniemi, Lempaala (FI); Antti Eronen, Tampere (FI); Jussi Artturi Leppanen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/957,823

(22) PCT Filed: Dec. 14, 2018

(86) PCT No.: PCT/IB2018/060137
§ 371 (c)(1),
(2) Date: Jun. 25, 2020

(87) PCT Pub. No.: WO2019/130151
PCT Pub. Date: Jul. 4, 2019

(65) Prior Publication Data

US 2021/0067895 A1 Mar. 4, 2021

(30) Foreign Application Priority Data

Dec. 29, 2017 (EP) ..... 17211014

(51) Int. Cl.
*H04S 7/00* (2006.01)

(52) U.S. Cl.
CPC ..... *H04S 7/304* (2013.01); *H04S 7/306* (2013.01); *H04S 2400/11* (2013.01)

(58) Field of Classification Search
CPC combination set(s) only.
See application file for complete search history.

(56) References Cited

U.S. PATENT DOCUMENTS 10,080,088 B1 * 9/2018 Yang ..... H04S 7/30
2003/0044002 A1 * 3/2003 Yeager ..... H04S 1/005 379/444

(Continued)

FOREIGN PATENT DOCUMENTS

CN 105191354 A 12/2015
CN 105284129 A 1/2016

(Continued)

OTHER PUBLICATIONS

Jada Sodnik et al., "Spatial Auditory Human-Computer Interfaces", Springer Briefs in Computer Science, Sep. 12, 2015, ISBM: 978-3-319-22110-6, pp. 53-59.

(Continued)

*Primary Examiner* — Duc Nguyen
*Assistant Examiner* — Assad Mohammed
(74) *Attorney, Agent, or Firm* — International IP Law Group, PLLC

(57) ABSTRACT

An apparatus, method and computer program, the apparatus including means for determining that perspective mediated content is available within content provided to a rendering device; and means for adding a notification to the content indicative that perspective mediated content is available; wherein the notification includes spatial audio effects added to the content.

20 Claims, 10 Drawing Sheets

(56) References Cited

U.S. PATENT DOCUMENTS

| | | | | |
|---|---|---|---|---|
| 2007/0253556 | A1* | 11/2007 | Nakao | H04M 19/04 381/2 |
| 2008/0144794 | A1* | 6/2008 | Gardner | H04M 3/568 379/202.01 |
| 2008/0240373 | A1* | 10/2008 | Wilhelm | H04N 21/8113 379/67.1 |
| 2012/0020502 | A1* | 1/2012 | Adams | H04S 7/304 381/310 |
| 2014/0270183 | A1* | 9/2014 | Luna | H04S 7/30 381/17 |
| 2015/0055770 | A1 | 2/2015 | Spittle et al. | 379/202.01 |
| 2015/0244868 | A1* | 8/2015 | Cartwright | H04M 3/569 370/260 |
| 2016/0027209 | A1 | 1/2016 | Demirli et al. | 19/3 |
| 2016/0134988 | A1 | 5/2016 | Gorzel et al. | |
| 2017/0013388 | A1* | 1/2017 | Fueg | G10L 19/20 |
| 2017/0188168 | A1* | 6/2017 | Lyren | H04S 7/305 |
| 2017/0257723 | A1* | 9/2017 | Morishita | H04R 5/033 |
| 2017/0366896 | A1* | 12/2017 | Adsumilli | G01S 5/28 |
| 2017/0372522 | A1 | 12/2017 | Eronen et al. | |

FOREIGN PATENT DOCUMENTS

| | | | |
|---|---|---|---|
| CN | 106471823 | A | 3/2017 |
| CN | 106576156 | A | 4/2017 |
| CN | 106796799 | A | 5/2017 |
| EP | 2214425 | A1 | 8/2010 |
| EP | 3 255 904 | A1 | 12/2017 |
| EP | 3264228 | A1 | 1/2018 |
| WO | WO-2012/023864 | A1 | 2/2012 |
| WO | WO 2014/184353 | A1 | 11/2014 |
| WO | WO 2014/184706 | A1 | 11/2014 |
| WO | 2017178309 | A1 | 10/2017 |
| WO | WO-2017/178705 | A1 | 10/2017 |

OTHER PUBLICATIONS

Stéphane Côté et al., "Third Person Perspective Augmented Reality for High Accuracy Applications", IEEE International Symposium on Mixed and Augmented Reality 2013 Science and Technology Proceedings, Oct. 1-4, 2013, Adelaide, SA, Australia, pp. 247-248.

* cited by examiner

APPARATUS, METHOD AND COMPUTER PROGRAM FOR PROVIDING NOTIFICATIONS

CROSS REFERENCE TO RELATED APPLICATION

This patent application is a U.S. National Stage application of International Patent Application Number PCT/IB2018/060137 filed Dec. 14, 2018, which is hereby incorporated by reference in its entirety, and claims priority to EP 17211014.0 filed Dec. 29, 2017.

TECHNOLOGICAL FIELD

Examples of the disclosure relate to an apparatus, method and computer program for providing notifications. In particular, they relate to an apparatus, method and computer program for providing notifications relating to perspective mediated content.

BACKGROUND

Perspective mediated content may comprise audio and/or visual content which represents an audio space and/or a visual space which has multiple dimensions. When the perspective mediated content is rendered the audio scene and/or the visual scene that is rendered is dependent upon a position of the user. This enables different audio scenes and/or different visual scenes to be rendered where the audio scenes and/or visual scenes correspond to different positions of the user.

Perspective mediated content may be used in virtual reality or augmented reality applications or any other suitable type of applications.

BRIEF SUMMARY

According to various, but not necessarily all, examples of the disclosure there is provided an apparatus comprising: means for determining that perspective mediated content is available within content provided to a rendering device; and means for adding a notification to the content indicative that perspective mediated content is available; wherein the notification comprises spatial audio effects added to the content.

The spatial audio effects of the notification may be temporarily added to the content.

The spatial audio effects added to the content may comprise one or more of, ambient noise, reverberation.

The notification may be added to the content by applying a room impulse response to the content. The room impulse response that is applied may be independent of a room in which the perspective mediated content was captured and a room in which the content is to be rendered.

The perspective mediated content may comprise content which has been captured within a three dimensional space which enables different audio scenes and/or visual scenes to be rendered via the rendering device wherein the audio scene and/or visual scene that is rendered is dependent upon a position of a user of the rendering device. The notification added to the content may produce a different audio effect to the audio scene corresponding to the user's position.

The notification added to the content may comprise the addition of reverberation to the content to create the audio effect that one or more audio objects are moving within the three dimensional space.

The perspective mediated content may comprise audio content.

The perspective mediated content may comprise content captured by a plurality of devices.

According to various, but not necessarily all, examples of the disclosure there is provided an apparatus comprising: processing circuitry; and memory circuitry including computer program code, the memory circuitry and the computer program code configured to, with the processing circuitry, cause the apparatus to: determine that perspective mediated content is available within content provided to a rendering device; and add a notification to the content indicative that perspective mediated content is available; wherein the notification comprises spatial audio effects added to the content According to various, but not necessarily all, examples of the disclosure there is provided a method comprising: determining that perspective mediated content is available within content provided to a rendering device; and adding a notification to the content indicative that perspective mediated content is available; wherein the notification comprises spatial audio effects added to the content.

The spatial audio effects of the notification may be temporarily added to the content.

The spatial audio effects added to the content may comprise one or more of, ambient noise, reverberation.

The notification may be added to the content by applying a room impulse response to the content. The room impulse response that is applied may be independent of a room in which the perspective mediated content was captured and a room in which the content is to be rendered.

The perspective mediated content may comprise content which has been captured within a three dimensional space which enables different audio scenes and/or visual scenes to be rendered via a rendering device wherein the audio scene and/or visual scene that is rendered is dependent upon a position of a user of the rendering device. The notification added to the content produces a different audio effect to the audio scene corresponding to the user's position.

The notification added to the content may comprise the addition of reverberation to the content to create the audio effect that one or more audio objects are moving within the three dimensional space.

The perspective mediated content may comprise audio content.

The perspective mediated content may comprise content captured by a plurality of devices.

According to various, but not necessarily all, examples of the disclosure there is provided a computer program comprising computer program instructions that, when executed by processing circuitry, cause: determining that perspective mediated content is available within content provided to a rendering device; and adding a notification to the content indicative that perspective mediated content is available; wherein the notification comprises spatial audio effects added to the content.

According to various, but not necessarily all, examples of the disclosure there is provided a physical entity embodying the computer program as described above.

According to various, but not necessarily all, examples of the disclosure there is provided an electromagnetic carrier signal carrying the computer program as described above.

According to various, but not necessarily all, examples of the disclosure, there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

The following description describes apparatus 1, methods, and computer programs 9 that control how content which may comprise perspective mediated content is rendered to a user. In particular they control how a user may be notified that perspective mediated content is available or that a new type of perspective mediated content has become available. The perspective mediated content may comprise an audio space and/or a visual space in which the audio scene and/or the visual scene that is rendered is dependent upon a position of the user.

Figure 1:
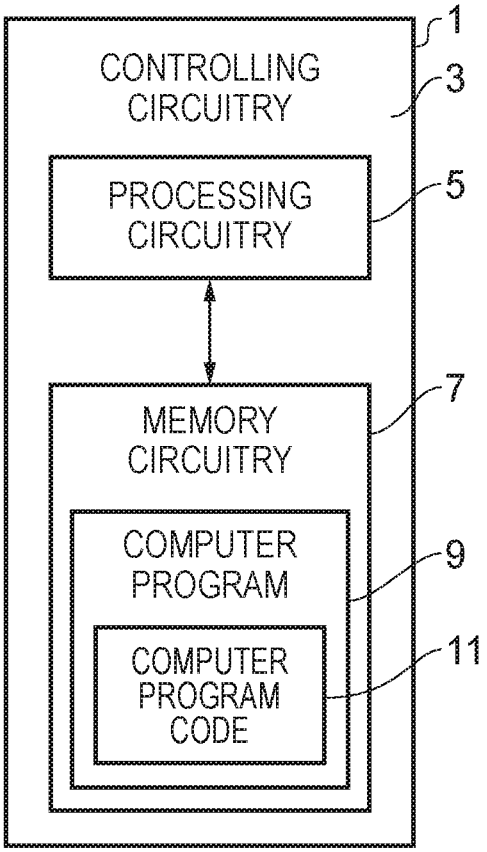
FIG. 1 illustrates an apparatus.

FIG. 1 schematically illustrates an apparatus 1 according to examples of the disclosure. The apparatus 1 illustrated in FIG. 1 may be a chip or a chip-set. In some examples the apparatus 1 may be provided within devices such as a content capturing device, a content processing device, a content rendering device or any other suitable type of device.

The apparatus 1 comprises controlling circuitry 3. The controlling circuitry 3 may provide means for controlling an electronic device such as a content capturing device, a content processing device, a content rendering device or any other suitable type of device. The controlling circuitry 3 may also provide means for performing the methods, or at least part of the methods, of examples of the disclosure.

The apparatus 1 comprises processing circuitry 5 and memory circuitry 7. The processing circuitry 5 may be configured to read from and write to the memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods described above. The processing circuitry 5 by reading the memory circuitry 7 is able to load and execute the computer program 9.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus may propagate or transmit the computer program 9 as a computer data signal. In some examples the computer program code 9 may be transmitted to the apparatus 1 using a wireless protocol such as Bluetooth, Bluetooth Low Energy, Bluetooth Smart, 6LoWPan ($IP_v6$ over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

Figure 2:
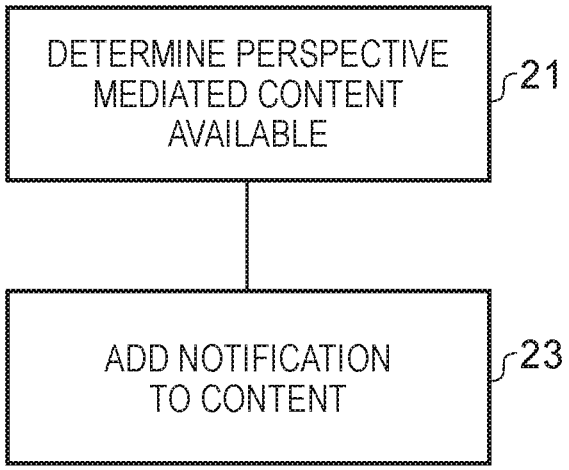
FIG. 2 illustrates a method.

FIG. 2 illustrates an example method which may be used in examples of disclosure. The method could be implemented using an apparatus 1 as shown in FIG. 1. The method could be implemented by an apparatus 1 within a content capturing device, within a content processing device, within a content rendering device or within any other suitable device. In some examples the blocks of the method could be distributed between one or more different devices.

The method comprises, at block 21, determining that perspective mediated content is available within content provided to a rendering device.

The content that is being provided to the rendering device could comprise audio content. The audio content could be generated by one or more audio objects which may be located at different positions within a space.

In some examples the content that is being provided to the rendering device could comprise visual content. The visual content could comprise images corresponding to the objects within the space. In some examples the visual content may correspond to the audio content so that the images in the visual content correspond to the audio content.

The content that is being provided to the rendering device at block 21 could be perspective mediated content or non-perspective mediated content. In some examples the content could be volumetric content or non-volumetric content.

The non-perspective mediated content could comprise audio or visual content where the audio scene and/or visual scene that is rendered by the rendering device is independent of the position of the user of the rendering device. The same audio scene and/or visual scene may be provided even if the user changes their orientation or location.

The audio perspective mediated content could represent an audio space. The audio space may be a multidimensional space. In examples of the disclosure the audio space could be a three dimensional space. The audio space may comprise one or more audio objects. The audio objects could be located at different positions within the audio space. In some examples the audio objects could be moving within the audio space.

Different audio scenes may be available within the audio space. The different audio scenes may comprise different representations of the audio space as listened to from particular points of view within the audio space.

For example the audio perspective mediated content could comprise audio generated by a band or plurality of musicians who may be located in different positions around a room. When the audio perspective mediated content is being rendered this enables a user to hear different audio scenes depending on how they rotate their head. The audio scene that is heard by the user may also be dependent on the position of the audio objects relative to the user. If the user moves through the audio space then this may change which audio objects are audible to the user and the volume, and other parameters, of the audio objects. For example, if the user starts at a first position located next to a musician playing the drums then they will mainly hear the audio provided by the drums, while if they move towards another musician playing a guitar, the sound of the guitar will increase relative to the sound provided by the drums. It is to be appreciated that this example is intended to be illustrative and that other examples for rendering audio perspective mediated content could be used in examples of the disclosure.

The visual perspective mediated content could represent a visual space. The visual space may be a multidimensional space. In examples of the disclosure the visual space could be a three dimensional space. The space represented by the visual space could be the same space as represented by the audio space.

Different visual scenes may be available within the visual space. The different visual scenes may comprise different representations of the visual space as viewed from particular points of view within the visual space. As with the audio perspective mediated content, the user can change the visual perspective mediated content that is rendered by changing their location and/or orientation within the visual space.

In some examples the content may comprise mediated reality content. This could be content which enables the user to visually experience a fully or partially artificial environment such as a virtual visual scene or a virtual audio scene. The mediated reality content could comprise interactive content such as a video game or non-interactive content such as a motion video or an audio recording. The mediated reality content could be augmented reality content, virtual reality content or any other suitable type of content.

The content may be perspective mediated content such that the point of view of the user within the spaces represented by the content changes the audio and/or the visual scenes that are rendered to the user. For instance, if a user of the rendering device rotates their head this will change the audio scenes and/or visual scenes that are rendered to the user.

Any suitable means may be used, at block 21, to determine that perspective mediated content is available. The means could comprise controlling circuitry 3, which may be as described above. In some examples the perspective mediated content could be obtained by a plurality of different capturing devices. In such examples it may be determined that perspective mediated content is available for the time periods where a plurality of capturing devices are capturing the content. This determination could be made by controlling circuitry 3 provided within the capturing devices, or controlling circuitry 3 provided within a communication system comprising the capturing devices or any other suitable means.

In some examples the content file comprising the perspective mediated content comprises metadata which indicates that the content is perspective mediated content. The metadata may indicate the number of degrees of freedom that the use has within the perspective mediated content, for example it may indicate whether the user has three degrees of freedom or six degrees of freedom. In some examples it may indicate the size of the volume in which the perspective mediated content is available. For example it, may indicate the virtual space in which the perspective mediated content is available. In such examples the metadata may be used to determine whether or not perspective mediated content is available.

In some examples different content files comprising different types of content may be available. For example a first file might contain non-perspective mediated content while a second file might contain perspective mediated content that allows for three degrees of freedom and a third file might contain perspective mediated content that allows for six degrees of freedom. In such examples it may be determined that perspective mediated content is available when the additional content files become available.

In some examples a single capturing device could obtain the perspective mediated content. In such examples controlling circuitry 3 of the capturing device may be arranged to provide an indication that perspective mediated content has been captured or a processing device could provide an indication that the captured content has been processed to provide perspective mediated content. In such examples the indication could provide a trigger which enables the apparatus 1 to determine that perspective mediated content is available.

The content may be provided to a rendering device. The rendering device may comprise any means that enables the content to be rendered for a user. The rendering of the content may comprise providing the content in a form that can be perceived by a user. The rendering of the content may comprise rendering the content as perspective mediated content. The content may be rendered by any suitable rendering device such as one or more headphones, one or more loud speakers one or more display units or any other suitable rendering devices. The rendering devices could be provided within more complex devices. For example a virtual reality head set could comprise headphones and one or more displays and a hand held device, such as mobile phone or tablet could comprise a display and one or more loudspeakers.

In some examples when the content is provided to the rendering device it may be rendered immediately. For example, a user could be live streaming audio visual content. In such examples the capturing of the content and the rendering of the content may be occurring simultaneously, or with a very small delay. In other examples when the content is provided to the rendering device it could be stored in one or more memories of the rendering device. This may enable the user to download content and use it at a later point in time. In such examples the rendering of the content and the capturing of the content would not be simultaneous.

The method also comprises, at block 23, adding a notification to the content indicating that perspective mediated content is available. The notification that is added comprises spatial audio effects which are added to the content. The notification therefore comprises a modification of the content rather than a separate notification that is provided in addition to the content.

The spatial audio effects that are added to the content may comprise any audio effects which could be used to provide an indication to the user that perspective mediated content is now available. In some examples the spatial audio effects could comprise the addition of ambient noise, or reverberation or any other suitable audio effects which enable a user to perceive that a notification has been added to the content.

The spatial audio effects that are added to the content may change any spatialisation of the audio content. This change may be perceived by the user to act as a notification that perspective mediated content is available. Where the content that is being rendered is non-perspective mediated content the addition of spatial effects to the content may be perceived by the user and act as an indication that perspective mediated content is now available. Where the content that is being rendered is perspective mediated content the addition of the spatial effects of the notification may change the spatial audio being rendered such that the user can perceive that the audio has changed. This may act as a notification that a different type of perspective mediated content is now available.

In some examples the content that is being provided to the rendering device might not comprise audio content. For example the content could be just visual content or the audio content could be very quiet when the perspective mediated content becomes available. In such examples the notification could comprise the application of an artificial audio object to the content. The spatial audio effects could then be added to the artificial audio object.

In some examples the addition of the spatial effects such as reverberation to the content may create the audio effect that one or more of the audio objects within the audio space are moving. In some examples the spatial effects may create the audio effect that the audio objects are moving away from the user. This may give the indication that the audio space is increasing in size which intuitively indicates that perspective mediated content is available.

The spatial audio effects that are added to the content may produce an audio effect that differs from the captured spatial audio content. That is the notification does not try to recreate a realistic audio experience for a user but provides a deviation from the audio content being provided so that the user is alerted to the fact that the availability of perspective mediated content has changed. Therefore the audio effect that is provided by the notification is, at least temporarily, different to the audio scene that corresponds to the user's position within the audio space.

In some examples a notification may be added to the content by applying a room impulse response to the content. The room impulse response that is applied is independent of either the room in which the perspective mediated content was captured or the room in which the content is to be rendered to the user. That is the room impulse response is not added to provide a realistic effect but to provide an audio alert for a user.

When the user hears the notification that the perspective mediated content is available they could then choose whether to access the perspective mediated content or not. For example a user may be able to make a user input to switch from the original content to the newly available perspective mediated content.

In some examples the notification that is added to the content may be added temporarily. For example the notification could be added to the content for a predetermined period of time. In some examples the effects comprised within the notification could be adjusted so that they fade away over a predetermined period of time. The predetermined period of time could be a number of seconds or any other suitable length of time. In other examples the notification could be added permanently. That is the notification could be added until it is removed by a user input. The user input could be the user selecting to use the perspective mediated content or not to use the perspective mediated content.

Figure 3A:
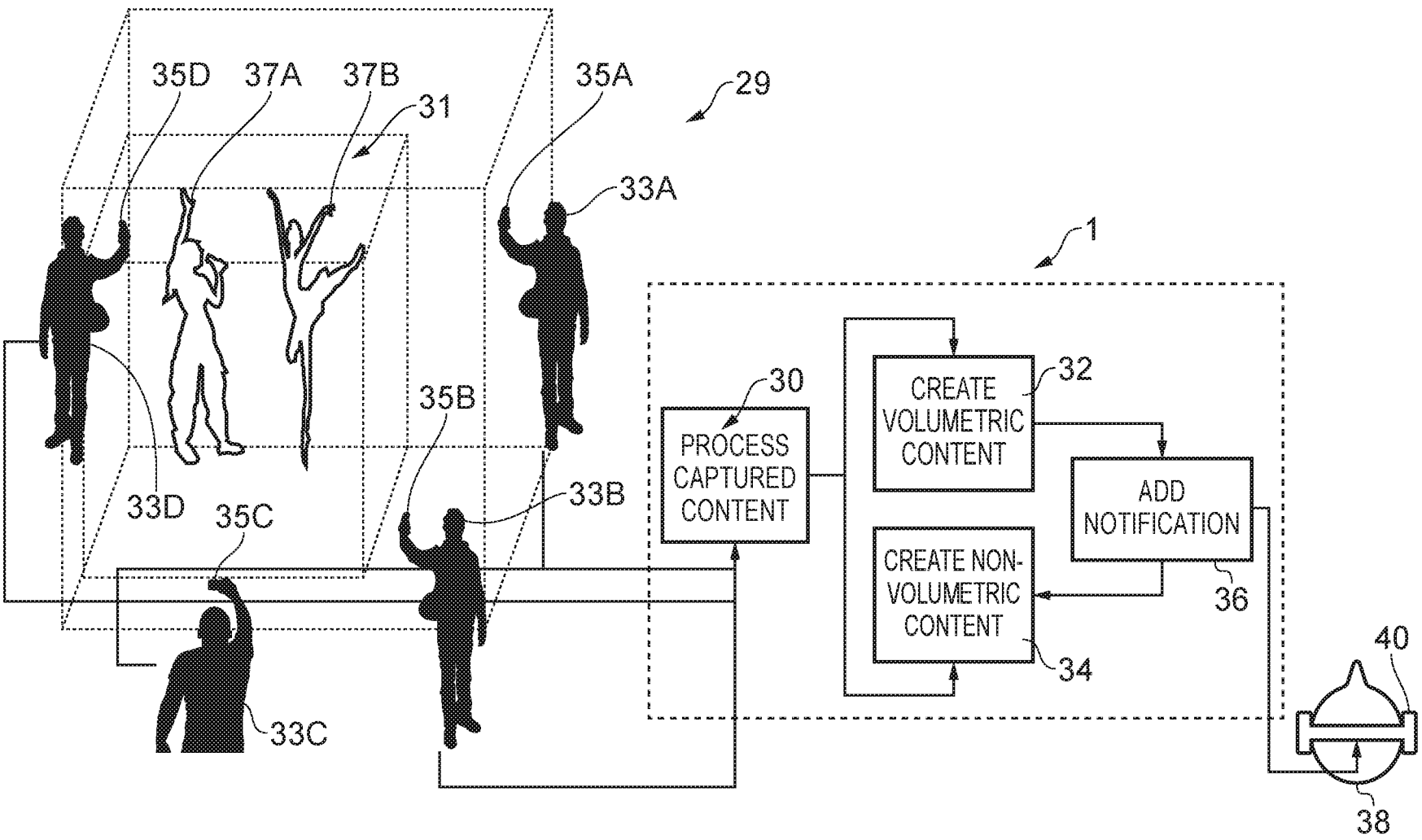
FIGS. 3A and 3B illustrate an example system.

FIG. 3A illustrates an example system 29 which may be used to implement examples of the disclosure. The example system 29 comprises a plurality of capturing devices 35A, 35B, 35C and 35D, an apparatus 1 and a rendering device 40.

The apparatus 1 may comprise controlling circuitry 3, as described above, which may be arranged to implement methods according to examples of the disclosure. For example the apparatus 1 could be arranged to implement the method, or at least part of the method shown in FIG. 2. In some examples the apparatus 1 may be provided within a capturing device 35A, 35B, 35C and 35D. In some examples the apparatus 1 could be provided within the rendering device 40. In some examples the apparatus 1 could be provided by one or more devices within the communication network such as one or more remote servers or one or more remote processing devices.

In the example of FIG. 3A the capturing devices 35A, 35B, 35C and 35D, the apparatus 1 and the rendering device 40 may be arranged to communicate via a communications network which could be a wireless communications network. The capturing devices 35A, 35B, 35C and 35D, the apparatus 1 and the rendering device 40 could be located in remote locations from each other. In the example of FIG. 3A the capturing devices 35A, 35B, 35C and 35D, the apparatus 1 and the rendering device 40 are shown as different entities. As mentioned above, in other examples the apparatus 1 could be provided within one or more of the capturing devices 35A, 35B, 35C and 35D or within the rendering device 40.

The capturing devices 35A, 35B, 35C and 35D may comprise any devices which may be arranged to capture audio content and/or visual content. The capturing devices 35A, 35B, 35C and 35D may comprise one or more microphones for capturing audio content, one or more cameras for capturing visual content or any other suitable components. In the example of FIG. 3A the capturing devices 35A, 35B, 35C and 35D comprise a plurality of communication devices such as cellular telephones. Other types of capturing devices 35A, 35B, 35C and 35D may be used in other examples of the disclosure.

In the example of FIG. 3A each of the capturing devices 35A, 35B, 35C and 35D is being operated by a different user 33A, 33B, 33C, and 33D. The users 33A, 33B, 33C, and 33D are located at different locations and may be capturing the same audio objects 37A, 37B from different perspectives.

In the example system 29 of FIG. 3A the plurality of users 33A, 33B, 33C and 33D are using the capturing devices 35A, 35B, 35C and 35D to capture the audio space 31. The audio space 31 comprises two audio objects 37A and 37B. The first audio object 37A comprises a singer and the second audio object 37B comprises a dancer. Either or both of the audio objects 37A and 37B may be moving within the audio space 31 while the audio content is being captured. The users 33A, 33B, 33C and 33D and the capturing devices 35A, 35B, 35C and 35D are spatially distributed around the audio space 31 to enable perspective mediated content to be generated.

In the example system of FIG. 3A four capturing devices 35A, 35B, 35C and 35D are used to capture the audio content. It is to be appreciated that any number of capturing devices 35A, 35B, 35C and 35D could be used to capture the content in other examples of the disclosure. The capturing devices 35A, 35B, 35C and 35D could be capturing the audio content independently of each other. There need not be any direct connection between any of the capturing devices 35A, 35B, 35C and 35D.

Each of the capturing devices 35A, 35B, 35C and 35D may provide the content that is being captured to the apparatus 1. The apparatus 1 may be as shown in FIG. 1. The apparatus 1 could be provided within one of the capturing devices 35A, 35B, 35C and 35D, within a remote server provided within a communications network, or within a rendering device 40 or within any other suitable type of device.

Once the apparatus 1 obtains the content the apparatus 1 may perform the method as shown in FIG. 3A. At block 30 the apparatus 1 processes the captured content. The processing of the captured content may comprise synchronising the content captured by the different capturing devices 35A, 35B, 35C and 35D and/or any other suitable type of processing.

In some examples the processing of the captured content as performed at block 30 may comprise determining the position of one or more of the capturing devices 35A, 35B, 35C and 35D. This may enable the extent of the audio space 31 covered by the capturing devices 35A, 35B, 35C and 35D to be determined.

Once the captured content has been processed then, at block 32, the apparatus 1 creates perspective mediated content and, at block 34, the apparatus 1 creates non-perspective mediated content. In the example of FIG. 3A the creation of the perspective mediated content and the non-perspective mediated content have been shown as separate blocks. It is to be appreciated that in other examples they could be provided as a single block.

The perspective mediated content may be created if there are a sufficient number of spatially distributed capturing devices 35A, 35B, 35C and 35D recording the audio space 31 to enable a three-dimensional space to be recreated. Different types of perspective mediated content may be created depending upon the content that has been captured by the capturing devices 35A, 35B, 35C and 35D.

In some examples the perspective mediated content may comprise a space in which the user has three degrees of freedom. In such examples the audio scene that is rendered by the rendering device 40 may depend on the angular orientation of the user's head. If the user rotates or changes the angular position of their head then this will cause a different audio scene to be rendered for the user. The user may be able to rotate their head about three different perpendicular axes to enable different audio scenes to be rendered.

The angular position of the user's head could be detected using one or more accelerometers, one or more micro-electromechanical devices, one or more gyroscopes or any other suitable means. The means for detecting the angular position of the user's head may be positioned within the rendering device 40.

In some examples the perspective mediated content may comprise a space in which the user has six degrees of freedom. In such examples the audio scene that is rendered by the rendering device 40 may depend on the angular orientation of the user's head as described above. The audio scene that is rendered by the rendering device 40 may also depend on the location of the user. If the user changes their location by moving along any of the three perpendicular axes then this this will cause a different audio scene to be rendered for the user. The user may be able to move along the three different perpendicular axes to enable different audio scenes to be rendered.

In some examples the perspective mediated content may comprise a space in which the user has three degrees of freedom plus. In such examples the audio scene that is rendered by the rendering device 40 may depend on the angular orientation of the user's head as with perspective mediated content which has three degrees of freedom. Where the user has three degrees of freedom plus the audio scene that is rendered by the rendering device 40 may also depend on the location of the user to a limited extent compared to content which has six degrees of freedom. This may allow for small movements of the user to cause a change in the audio scene, for example it may allow for a seated user to shift their position in the seat and cause a change in the audio scene.

The location of the user could be detected using positioning sensors such as GPS (global positioning system) sensors, HAIP (high accuracy indoor positioning) sensors or any other suitable types of sensors. The means for detecting the location of the user may be positioned within the rendering device 40.

In some examples the size of audio space within which the perspective mediated content can be provided may change. For example if more capturing devices 35A, 35B, 35C and 35D are used this may enable a larger sound space 31 to be captured. This may increase the volume within which the user has six degrees of freedom. It may increase the distance along the three axes that the user can move to enable different audio scenes to be rendered. It may change the type of perspective mediated content from content in which the user has three degrees of freedom plus to content in which the user has six degrees of freedom.

The type of perspective mediated content that is available may depend on the number of capturing devices 35A, 35B, 35C and 35D being used to capture the audio space 31 and also the spatial distribution of the capturing devices 35A, 35B, 35C and 35D.

The non-perspective mediated content may comprise content in which the audio scene that is rendered is independent of the position of the user 38 of the rendering device 40. The non-perspective mediated content may comprise the content as it would be captured by a single capturing device 35.

The non-perspective mediated content may always be available irrespective of the numbers and respective location of the capturing devices 35A, 35B, 35C and 35D being used to capture the audio space 31. The non-perspective mediated content may comprise non-volumetric content.

If a new type of perspective mediated content becomes available then, at block 36, a notification is added to the content currently being provided to the rendering device 40. The content currently being provided to the rendering device 40 could comprise non-perspective mediated content or perspective mediated content of a first type.

The notification provides an indication that a new type of perspective mediated content is available. The notification that is added may be indicative of the new type of perspective mediated content that has become available. For example, it may indicate whether the content enable three degrees of freedom, three degrees of freedom plus, six degrees of freedom or any other type of content.

The notification that is added comprises spatial audio effects. The spatial audio effects that are added are not be intended to recreate the audio space 31 as captured and therefore need not provide a realistic representation of the audio space 31. Instead the notification may comprise the addition of reverberation or other sound effects to the audio content which may create the sensation that the audio space 31 has changed. For example the addition of reverberation to one or more audio objects may create the sensation that the audio objects have moved away.

Once the notification has been added to the content, the content with the notification is provided to a rendering device 40. The rendering device 40 then renders the content and the notification so that they can be perceived by the user 38 of the rendering device 40.

Figure 3B:
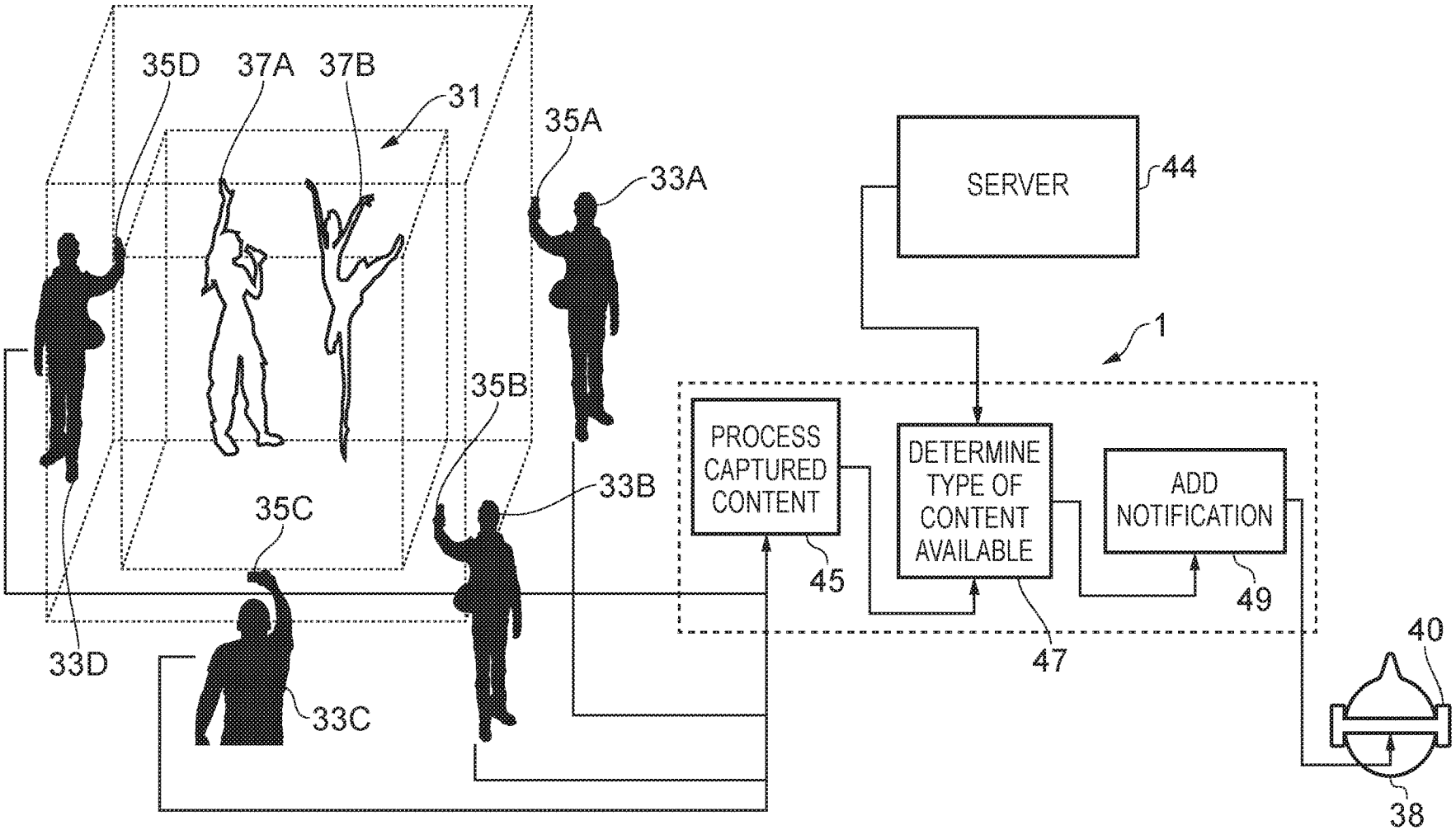

FIG. 3B illustrates another example system 29 which may be used to implement examples of the disclosure. The example system 29 of FIG. 3B also comprises a plurality of capturing devices 35A, 35B, 35C and 35D, an apparatus 1 and a rendering device 40 which may be similar to the capturing devices 35A, 35B, 35C and 35D, apparatus 1 and rendering device 40 as shown in FIG. 3A. In the example of FIG. 3B the system 29 also comprises a sever 44.

The sever 44 may comprise controlling circuitry 3, as described above, which may be arranged to implement methods, or parts of methods, according to examples of the disclosure. For example the sever 44 could be arranged to implement the method, or at least part of the method shown in FIG. 2. The server 44 could be located remotely to the capturing devices 35A, 35B, 35C and 35D, apparatus 1 and rendering device 40. The server 44 could be arranged to communicate with the capturing devices 35A, 35B, 35C and 35D, apparatus 1 and rendering device 40 via a wireless communications network or via any other suitable means.

In some examples the server 44 may be arranged to store content which may be perspective mediated content. The perspective mediated content could be provided from the server 44 to the apparatus 1 and the rendering device 40 to enable the perspective mediated content to be rendered to the user 38.

In the example of FIG. 3B each of the capturing devices 35A, 35B, 35C and 35D is being operated by a different user 33A, 33B, 33C, and 33D. The users 33A, 33B, 33C, and 33D are located at different locations and may be capturing the same audio objects 37A, 37B from different perspectives.

In the example system 29 of FIG. 3B the plurality of users 33A, 33B, 33C and 33D are using the capturing devices 35A, 35B, 35C and 35D to capture the audio space 31. The audio space 31 comprises two audio objects 37A and 37B. The first audio object 37A comprises a singer and the second audio object 37B comprises a dancer. Either or both of the audio objects 37A and 37B may be moving within the audio space 31 while the audio content is being captured. The users 33A, 33B, 33C and 33D and the capturing devices 35A, 35B, 35C and 35D are spatially distributed around the audio space 31 to enable perspective mediated content to be generated.

In the example system of FIG. 3B four capturing devices 35A, 35B, 35C and 35D are used to capture the audio content. It is to be appreciated that any number of capturing devices 35A, 35B, 35C and 35D could be used to capture the content in other examples of the disclosure. The capturing devices 35A, 35B, 35C and 35D could be capturing the audio content independently of each other. There need not be any direct connection between any of the capturing devices 35A, 35B, 35C and 35D.

Each of the capturing devices 35A, 35B, 35C and 35D may provide the content that is being captured to the apparatus 1. The apparatus 1 may be as shown in FIG. 1. The apparatus 1 could be provided within one of the capturing devices 35A, 35B, 35C and 35D, or within a remote server 44 provided within a communications network, or within a rendering device 40 or within any other suitable type of device.

Once the apparatus 1 obtains the content the apparatus 1 may perform the method as shown in FIG. 3B. At block 45 the apparatus 1 processes the captured content. The processing of the captured content may comprise synchronising the content captured by the different capturing devices 35A, 35B, 35C and 35D and/or any other suitable type of processing.

Once the captured content has been processed then, at block 47, the apparatus 1 determines the type of content available. At block 47 the apparatus 1 may determine if the content available is non-perspective mediated content or perspective mediated content. In some examples the apparatus 1 may determine the type of perspective mediated content that is available. For example the apparatus 1 may determine the degrees of freedom that are available to the user when rendering the perspective mediated content.

Determining the type of content available may comprise determining the type of content that has been captured by the capturing devices 35A, 35B, 35C and 35D and/or determining the type of content that is available on the server 44. For example the content captured by the capturing devices 35A, 35B, 35C and 35D could be non-perspective mediated content however there may be perspective mediated content relating to the same audio space 31 stored on the server 44. In such examples the server 44 could add metadata to the perspective mediated content stored there. The metadata could indicate the type of perspective mediated content. The server 44 can provide the content and the metadata to the apparatus 1. The apparatus 1 may use the metadata to determine the type of perspective mediated content which is available.

If a new type of perspective mediated content becomes available then, at block 49, a notification is added to the content currently being provided to the rendering device 40. The content currently being provided to the rendering device 40 could comprise non-perspective mediated content or perspective mediated content of a first type.

The notification provides an indication that a new type of perspective mediated content is available. The notification that is added may be indicative of the new type of perspective mediated content that has become available. For example, it may indicate whether the content enable three degrees of freedom, three degrees of freedom plus, six degrees of freedom or any other type of content.

The notification that is added comprises spatial audio effects similar to the effects provided in the system 29 of FIG. 3A. Other types of audio effects could be used in other examples of the disclosure.

Once the notification has been added to the content, the content with the notification is provided to a rendering device 40. The rendering device 40 then renders the content and the notification so that they can be perceived by the user 38 of the rendering device 40.

In the example systems of both FIGS. 3A and 3B the rendering device 40 comprises a set of earphones arranged to provide an audio output to the user 38. It is to be appreciated that in other examples other types of rendering devices 40 could be used. For example the rendering device 40 could comprise a communication device such as a mobile telephone, a headset comprising a display or any other suitable type of rendering device 40.

Once the user 38 of the rendering device 40 has received the notification that a new type of perspective mediated content is available they could ignore the notification and continue using the original content or they could make a user input to switch to the new type of perspective mediated content.

In some examples different types of perspective mediated content may be available. For example the first type of perspective mediated content may be a stereo audio output which could be provided to a set of headphones, this may give the end user three degrees of freedom in that they can rotate their head into different orientations and different orientations of the user's head provides them with different audio scenes.

In some examples the perspective mediated content may enable six degrees of freedom of the user. This may enable the user not only to rotate their head about three different axis but may also enable the user to move their location within the space. That is this may enable the user to move forwards backwards sideways and/or in a vertical direction in order to change the sound scene that is provided to them. The notification that is added to the non-perspective mediated content may provide an indication of the type of perspective mediated content that has become available. In some examples the amount of spatial audio effect that is added to the non-perspective mediated content may provide an indication of the type of perspective mediated content that has become available. For example a larger amount of spatial audio effects may be added if the perspective mediated content enables six degrees of freedom than if the perspective mediated content enables three degrees of freedom. This may enable the user to determine not only that perspective mediated content is available but may be able to distinguish between the different types of perspective mediated content that have become available. In addition if the rendering device is currently rendering the first type of perspective mediated content then the notification could be added to provide an indication that the second, different type of perspective mediated content has become available. For example if the user is currently rendering content that enables three degrees of freedom then the notification could be added if perspective mediated content enabling six degrees of freedom becomes available.

In the example of FIGS. 3A and 3B the perspective mediated content that is created comprises audio content. Specifically the perspective mediated content comprises the sound space 31. It is to be appreciated that other types of content could be used in other examples for disclosure. For example, in some instances the content could comprise visual content and some examples of content could comprise both audio and visual content. In some examples the audio content may be perspective mediated content or the visual content could be non-perspective mediated content. The content could comprise live content which is rendered simultaneously, or with a small delay, after being captured. In other examples the content could comprise stored content which may be stored in the rendering device 40 or at a remote device. The content could comprise a plurality of different content files which may correspond to different virtual spaces and/or different points in time. The content may enable different types of perspective mediated content to be available for different portions of the content.

Figure 4A:
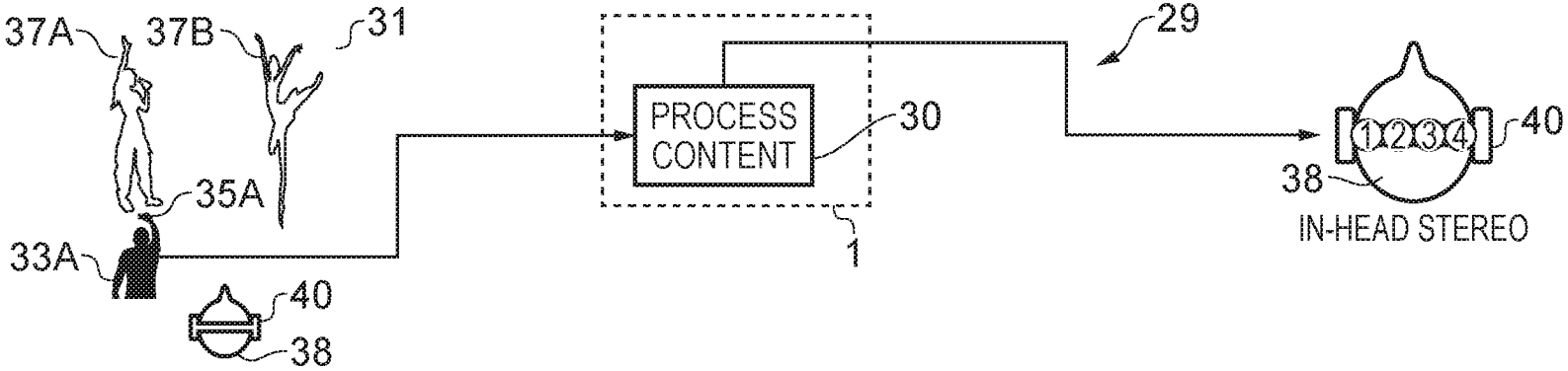
FIGS. 4A to 4C illustrate example systems producing different types of perspective mediated content.
Figure 4B:
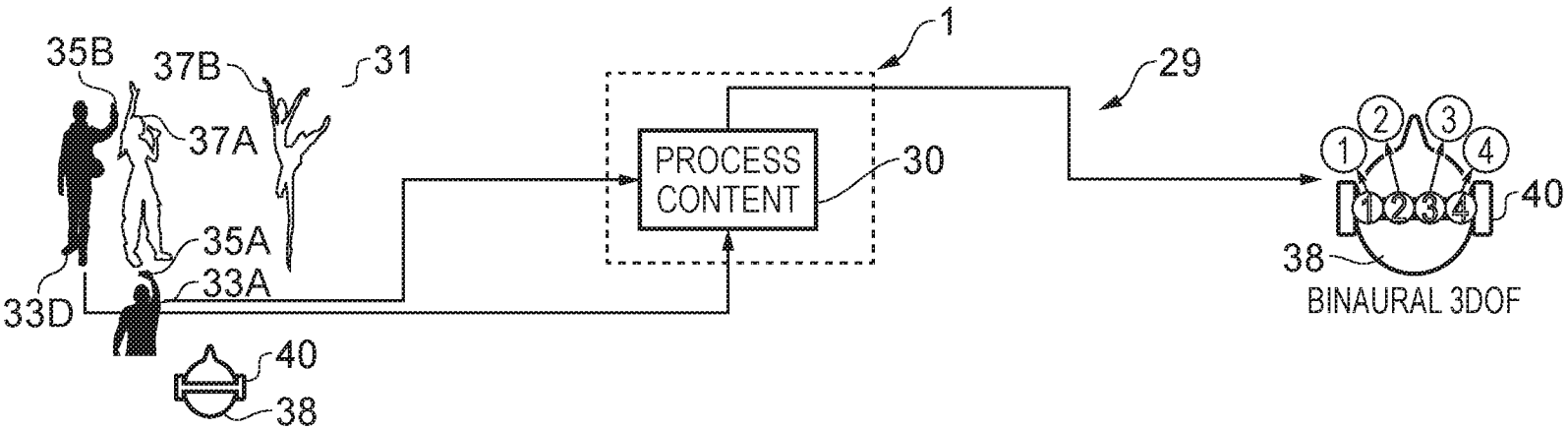
Figure 4C:
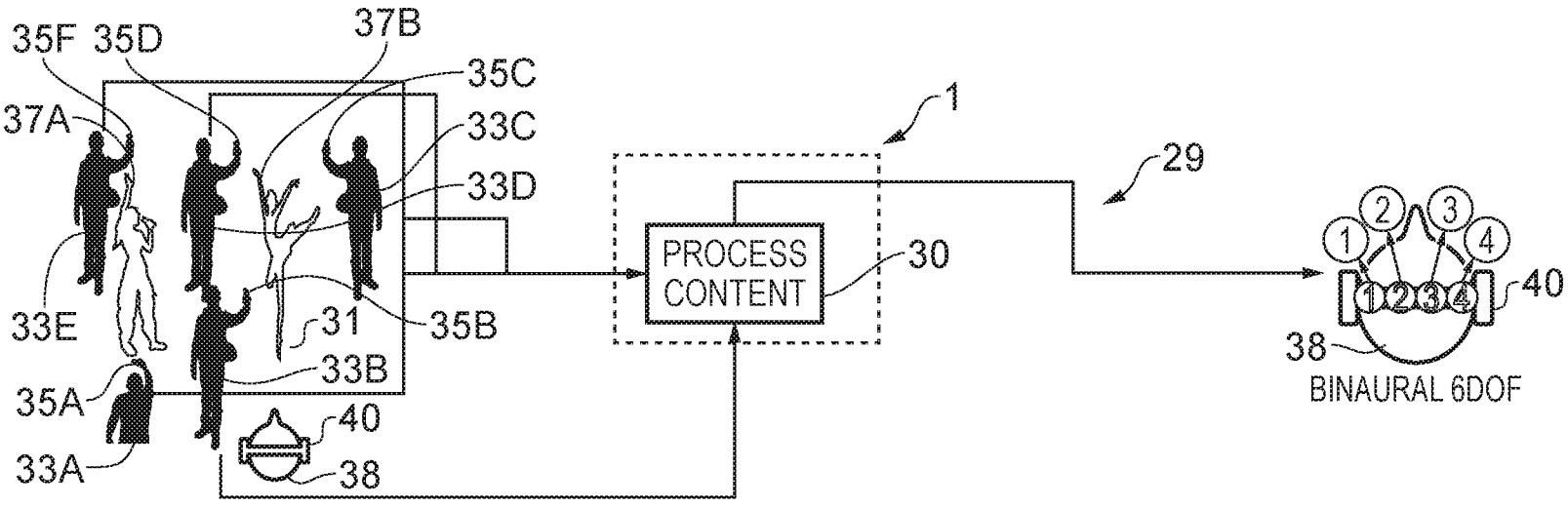

FIGS. 4A to 4C illustrate example systems 29 in which different types of perspective mediated content are available. Each of the examples systems 29 comprise one or more capturing devices 35 arranged to capture an audio space 31, an apparatus 1 and at least one rendering device 40. The systems 29 shown in FIGS. 4A to 4C could represent the same system at different points in time as different capturing devices 35 are used.

The audio space 31 that is being captured in FIGS. 4A to 4C is the same as the audio space 31 shown in FIGS. 3A and 3B. The example audio space 31 comprises two sound objects, a singer 37A and a dancer 37B. It is to be appreciated that other audio spaces 31 and other audio objects 37 could be used in other examples of the disclosure.

In the example system of FIG. 4A only one capturing device 35A is being used to capture the audio space 31. The capturing device 35A could be operated by a first user 33A. The audio content captured by the single capturing device 35A is provided to the apparatus 1 to enable the apparatus 1 to process 30 the audio content.

In the example system 29 of FIG. 4A only a single viewpoint is used to capture the audio content and so perspective mediated content is not available. In this example the apparatus 1 creates some non-perspective mediated content but does not create any perspective mediated content. The content that is provided from the apparatus 1 to the rendering device 40 therefore comprises non-perspective mediated content. The non-perspective mediated content could be mono audio content, or stereo audio content or any other suitable type of content.

The rendering device 40 comprises a set of head phones which enables the audio content to be provided to the user 38 of the rendering device. Other types of rendering device 40 could be used in other examples of the disclosure.

In the example system 29 of FIG. 4B two capturing devices 35A, 35B are being used to capture the audio space 31. The capturing devices 35A, 35B could be operated by two different users 33A, 33B. For example a second user 33A, may have joined the first user 33A to capture the audio space 31. This now provides two different positions from which the audio space 31 is being captured.

The captured audio content from both of the capturing devices 35A, 35B is provided to the apparatus 1 to enable the apparatus to process 30 the audio content. The processing of the audio content may comprise synchronising the two captured audio streams, determining the locations of the capturing devices 35A, 35B or any other suitable processing. The apparatus 1 may also use the two captured audio streams to create both perspective mediated content and non-perspective mediated content.

The apparatus 1 may perform any suitable processing to create the perspective mediated content. For example, the processing to provide perspective mediated content could comprise the addition of room impulse responses, the application of head relation transfer functions or any other suitable spatial audio effects. The processing performed on the captured audio content to enable perspective mediated content to be created may be designed to enable the audio content that is rendered by the rendering device 40 to, as closely as possible, recreate the audio space 31 that has been captured by the capturing devices 35A and 35B. That is the processing of the captured content to provide the perspective mediated content is intended to provide a realistic spatial audio effect.

When the perspective mediated content becomes available the apparatus 1 adds a notification to the content that is being provided to the rendering device 40. In the example of FIG. 4B the notification is added to the non-perspective mediated content which could correspond to the content as recorded as recorded by the first capturing device 35A.

In the example of FIG. 4B the perspective mediated content comprises binaural content. The binaural content provides the user 38 of the rendering device 40 with three degrees of freedom of movement. When the binaural content is being rendered the orientation of the user's head will dictate the audio scene that is rendered by the rendering device 40. By moving their head to different angular orientations the user 38 can thereby change the audio scene that is rendered to them.

In the example system 29 of FIG. 4C five capturing devices 35A, 35B, 35C, 35D and 36E are being used to capture the audio space 31. The capturing devices 35A, 35B, 35C, 35D and 36E could be operated by five different users 33A, 33B, 33C, 33D and 33E. For example three more users 33C, 33D and 33E, may have joined the first user 33A and the second user 33B to capture the audio space 31. This now provides five different positions from which the audio space 31 is being captured.

The captured audio content from all five of the capturing devices 35A, 35B, 35C, 35D and 36E is provided to the apparatus 1 to enable the apparatus to process 30 the audio content. The processing of the audio content may comprise synchronising the plurality captured audio streams, determining the locations of the 35A, 35B, 35C, 35D and 36E or any other suitable processing. The apparatus 1 may also use the plurality of captured audio streams to create both perspective mediated content and non-perspective mediated content. The perspective mediated content could be created using the similar processes as used in the example of FIG. 4B or any other suitable processes.

In the example of FIG. 4C the increased number of capturing devices 35A, 35B, 35C, 35D and 36E may enable a different type of perspective mediated content to be created. For example it may enable the distances between the audio objects 37A, 37B as well as the angular positions of the audio objects 37A, 37B to be taken into account. This may enable perspective mediated content with six degrees of freedom to be created. In some examples the increase in the number of capturing devices 35A, 35B, 35C, 35D and 36E may increase the size of the audio space 31 for which perspective mediated content can be created.

When the new type of perspective mediated content becomes available the apparatus 1 adds a notification to the content that is being provided to the rendering device 40. In the example of FIG. 4C the notification could be added to the non-perspective mediated content or binaural content depending on the type of content that the user 38 of the rendering device 40 has chosen to consume.

The notification that is added to the content in the example of FIG. 4C could be a different notification to the one that is added in the example of FIG. 4B. This may enable different notifications to be used to indicate that different types of perspective mediated content are available. For instance a larger amount of spatial audio effects may be added to the content in FIG. 4C than would be added to the content in FIG. 4B. This larger amount of spatial audio effects provides an indication that more degrees of freedom are available or that the perspective mediated content is now available for a larger audio space 31.

In the example systems of FIGS. 4A to 4C the different types of perspective mediated content become available as more users 33A, 33B, 33C, 33D and 33E and their capturing devices 35A, 35B, 35C 35D, and 35E become available to capture the audio space 31. It is to be appreciated that in other examples other reasons may cause perspective mediated content to be available or unavailable. For example, in some cases the perspective mediated content could be obtained by a single capturing device 35. In such cases the capturing device 35 might not always operate so that perspective mediated content can be created. In such cases there may be some times when perspective mediated content is available and other times when the perspective mediated content is not available. Examples of the disclosure could be used to notify a user 38 of a rendering device 40 of the changes in the availability of the perspective mediated content.

Figure 5B:
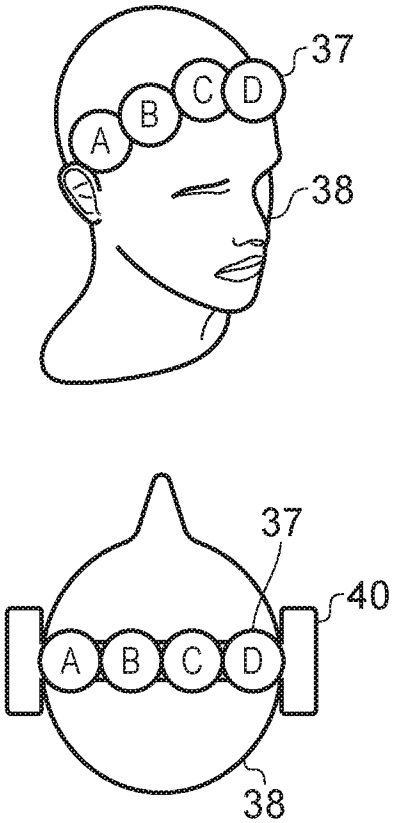
FIGS. 5A to 5B illustrate a system providing a first type of perspective mediated content.
Figure 5A:
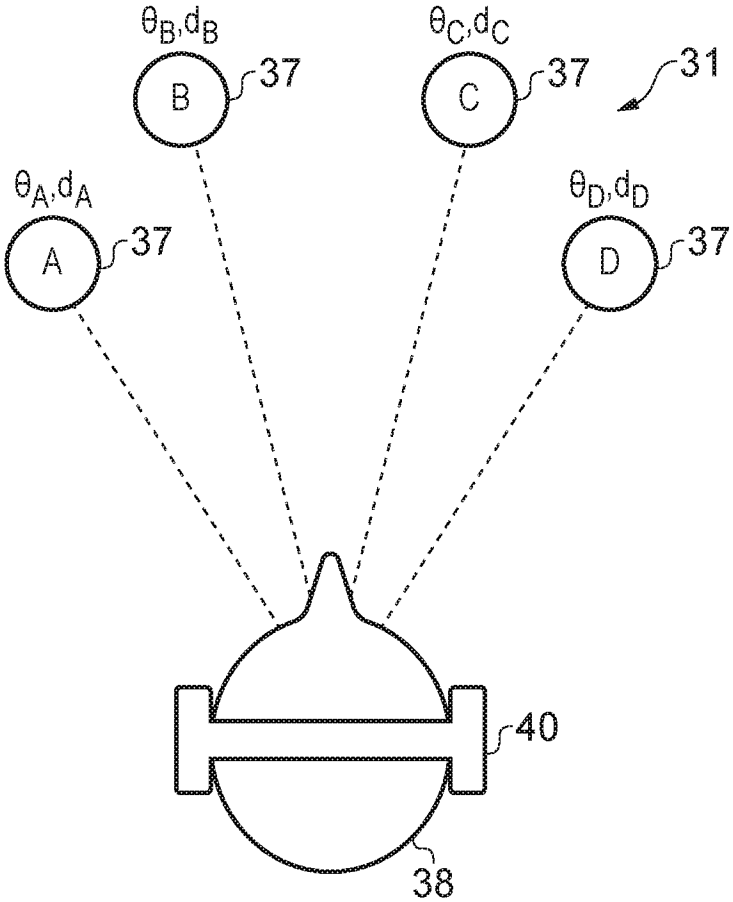

FIGS. 5A and 5B show an example in which the perspective mediated content is not available. FIG. 5A shows the real audio space 31 that has been captured by one or more capturing devices and FIG. 5B shows how this could be represented to the user 38 of the rendering device 40.

The real audio space 31 comprises a plurality of audio objects 37A, 37B, 37C and 37D. The audio objects 37A, 37B, 37C and 37D are positioned at different angular positions and different distances from the listening position of the user 38 of the rendering device 40. In the example of FIG. 5A the first audio object 37A is located at an angle $\theta_A$ and distance $d_A$, the second audio object 37B is located at an angle $\theta_B$ distance $d_B$, the third audio object 37C is located at an angle $\theta_C$ and distance $D_C$ and the fourth audio object 37D is located at an angle $\theta_D$ and distance $d_D$.

In the example of FIGS. 5A and 5B the perspective mediated content is not available. There could be any number of reasons why the perspective mediated content is not available. For example, the audio space 31 could have been captured by a single capturing device 35 or a capturing device arranged to obtain spatial audio might not have been functioning correctly or any other suitable reason.

FIG. 5B represents the audio content being rendered to the user 38 of the rendering device 40. This shows that the audio objects 37A, 37B, 37C and 37D are not rendered with any angular or distance distinction so that the same audio scene is provided to the user 38 irrespective to the location of the user 38 or the angular orientation of their head.

Figure 6B:
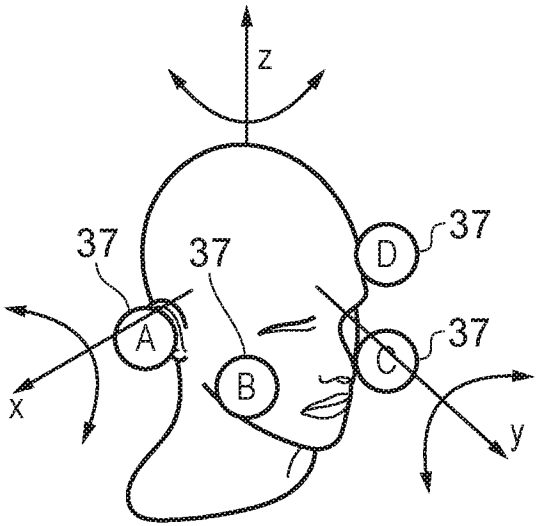
FIGS. 6A to 6B illustrate a system providing a second type of perspective mediated content.
Figure 6B:
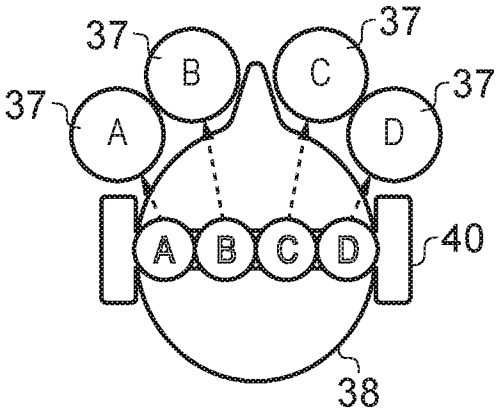
Figure 6A:
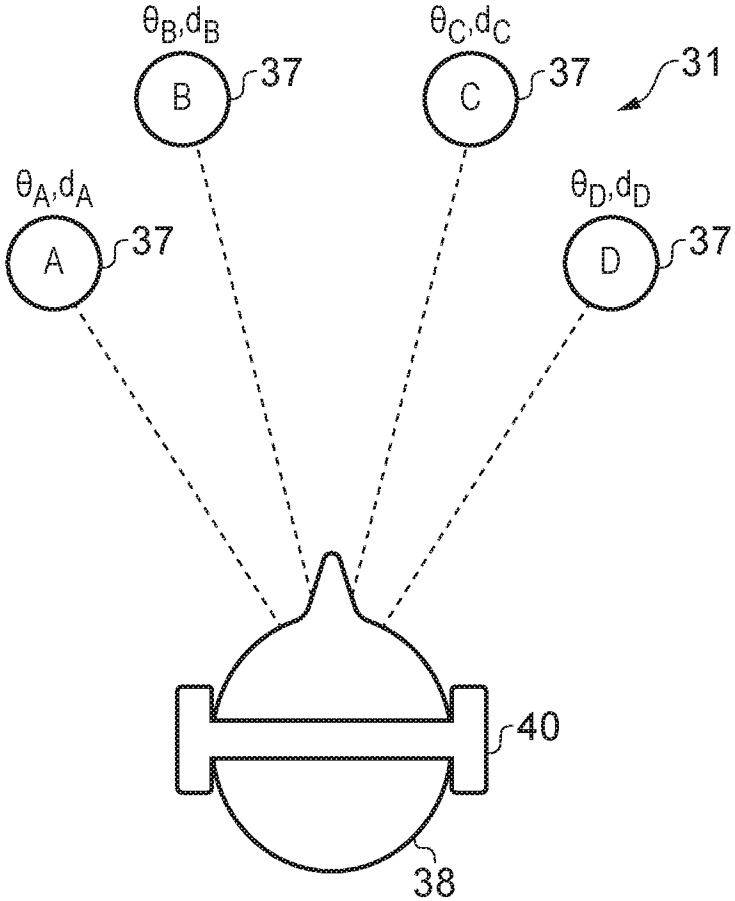

FIGS. 6A and 6B illustrate an example in which perspective mediated content is become available. FIG. 6A shows the real audio space 31 that has been captured by one or more capturing devices and FIG. 6B shows how this could be represented to the user 38 of the rendering device 40.

The real audio space 31 comprises a plurality of audio objects 37A, 37B, 37C and 37D. The audio objects 37A, 37B, 37C and 37D are positioned at different angular positions and different distances from the listening position of the user 38 of the rendering device 40. In the example of FIG. 6A the first audio object 37A is located at an angle $\theta_A$ and distance $d_A$, the second audio object 37B is located at an angle $\theta_B$ distance $d_B$, the third audio object 37C is located at an angle $\theta_C$ and distance $D_C$ and the fourth audio object 37D is located at an angle $\theta_D$ and distance $d_D$. In the example of FIG. 6A all of the audio objects 37A, 37B, 37C and 37D are located at equal distances from the listening position of the user 38. It is to be appreciated that in other examples the audio objects 37A, 37B, 37C and 37D could be located at different distances from the listening position.

In the example of FIGS. 6A and 6B the audio scene 31 is captured so that the apparatus 1 can determine the angles θ for each of the audio objects 37A, 37B, 37C and 37D. When the apparatus 1 is creating the perspective mediated content this may enable the direction of arrival to be determined for each of the audio objects 37A, 37B, 37C and 37D. This may enable perspective mediated content to be created in which the angular position of each of the audio objects 37A, 37B, 37C and 37D can be recreated.

FIG. 6B represents the audio content being rendered to the user 38 of the rendering device 40. This shows that the audio objects 37A, 37B, 37C and 37D are rendered so that the user 38 can perceive the different angular positions of each of the audio objects 37A, 37B, 37C and 37D.

The user 38 may be able to rotate their head about three different perpendicular axes x, y and z. The rendering device 40 may detect the angular position of the user's head about these three axes and use this information to control the audio scene that is rendered by the rendering device 40. Different audio scenes may be rendered for different angular orientations of the user's head.

When the perspective mediated content as shown in FIGS. 6A and 6B becomes available a notification could be added to the content being provided to the rendering device 40 to indicate that the perspective mediated content has become available.

Figure 7B:
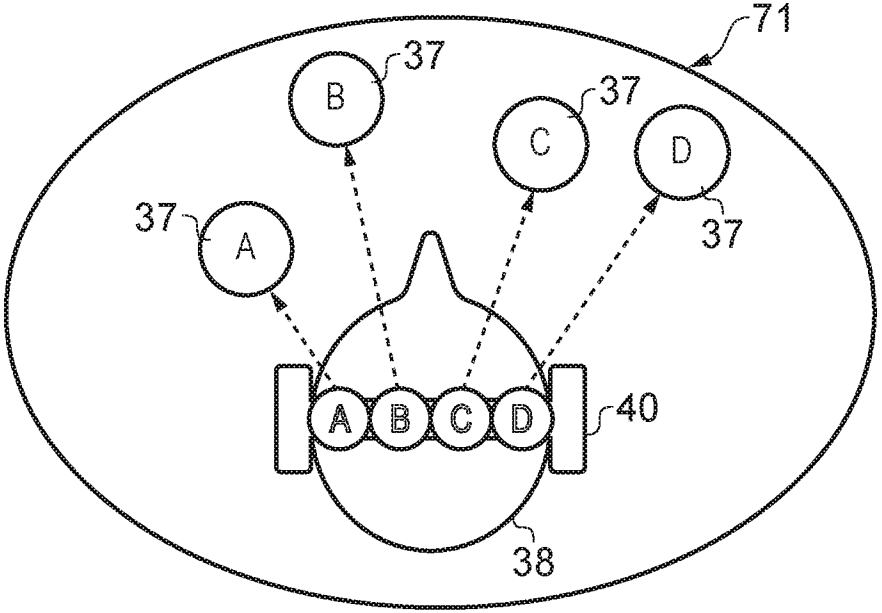
FIGS. 7A to 7B illustrate a system providing a third type of perspective mediated content.
Figure 7A:
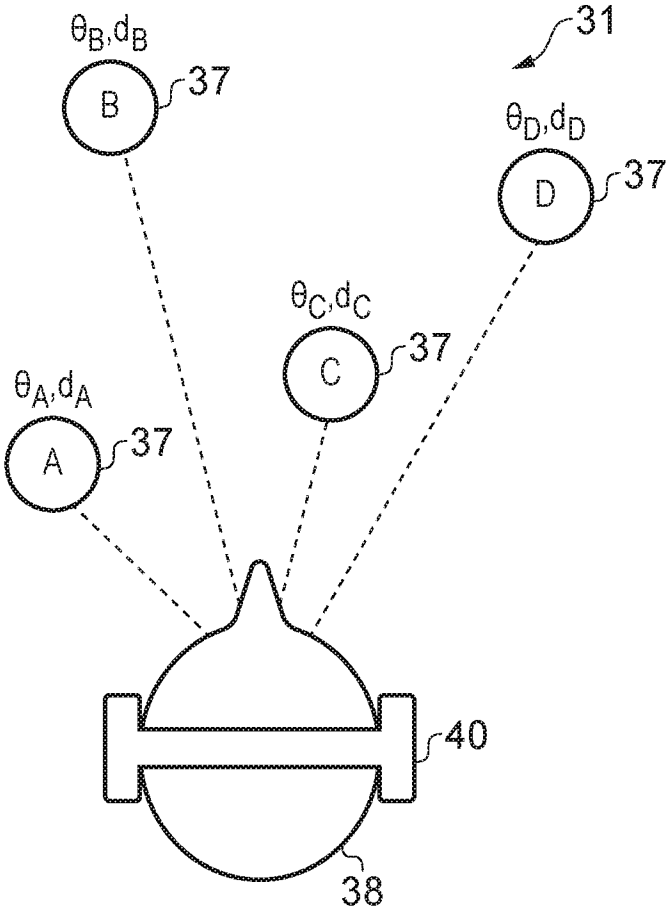

FIGS. 7A and 7B illustrate an example in which a new type of perspective mediated content has become available. FIG. 7A shows the real audio space 31 that has been captured by one or more capturing devices and FIG. 7B shows how this could be represented to the user 38 of the rendering device 40.

In the example of FIGS. 7A and 7B the audio scene 31 is captured so that the apparatus 1 can determine the angles θ for each of the audio objects 37A, 37B, 37C and 37D and also the distance between the audio objects 37A, 37B, 37C and 37D and the listening position of the user 38. When the apparatus 1 is creating the perspective mediated content this may enable both the direction of arrival and the distance between the user 38 and the audio object 37A, 37B, 37C and 37D to be determined for each of the audio objects 37A, 37B, 37C and 37D. This may enable perspective mediated content to be created in which the angular position and the relative distance of each of the audio objects 37A, 37B, 37C and 37D can be recreated.

FIG. 7B represents the audio content being rendered to the user 38 of the rendering device 40. This shows that the audio objects 37A, 37B, 37C and 37D are rendered so that the user 38 can perceive the different angular positions of each of the audio objects 37A, 37B, 37C and 37D and can also move within a virtual audio space 71.

The virtual audio space 71 is indicated by the grey area in FIG. 7B. In the example of FIG. 7B the virtual audio space 71 comprises an oval shaped area. Other shapes for the virtual audio space 71 could be used in other examples of the disclosure.

The user 38 may be able to move within the virtual audio space 71 by moving along of the three perpendicular axes x, y and z. For example, the user 38 could move side to side, backwards and forwards or up and down or any combination of these directions. The rendering device 40 may detect the location of the user 38 within the virtual audio space 71 and may use this information to control the audio scene that is rendered by the rendering device 40. Different audio scenes may be rendered for different positions within the virtual audio space 71.

When the perspective mediated content with six degrees of freedom as shown in FIGS. 7A and 7B becomes available a notification could be added to the content being provided to the rendering device 40 to indicate that the new type of perspective mediated content has become available.

Figure 8B:
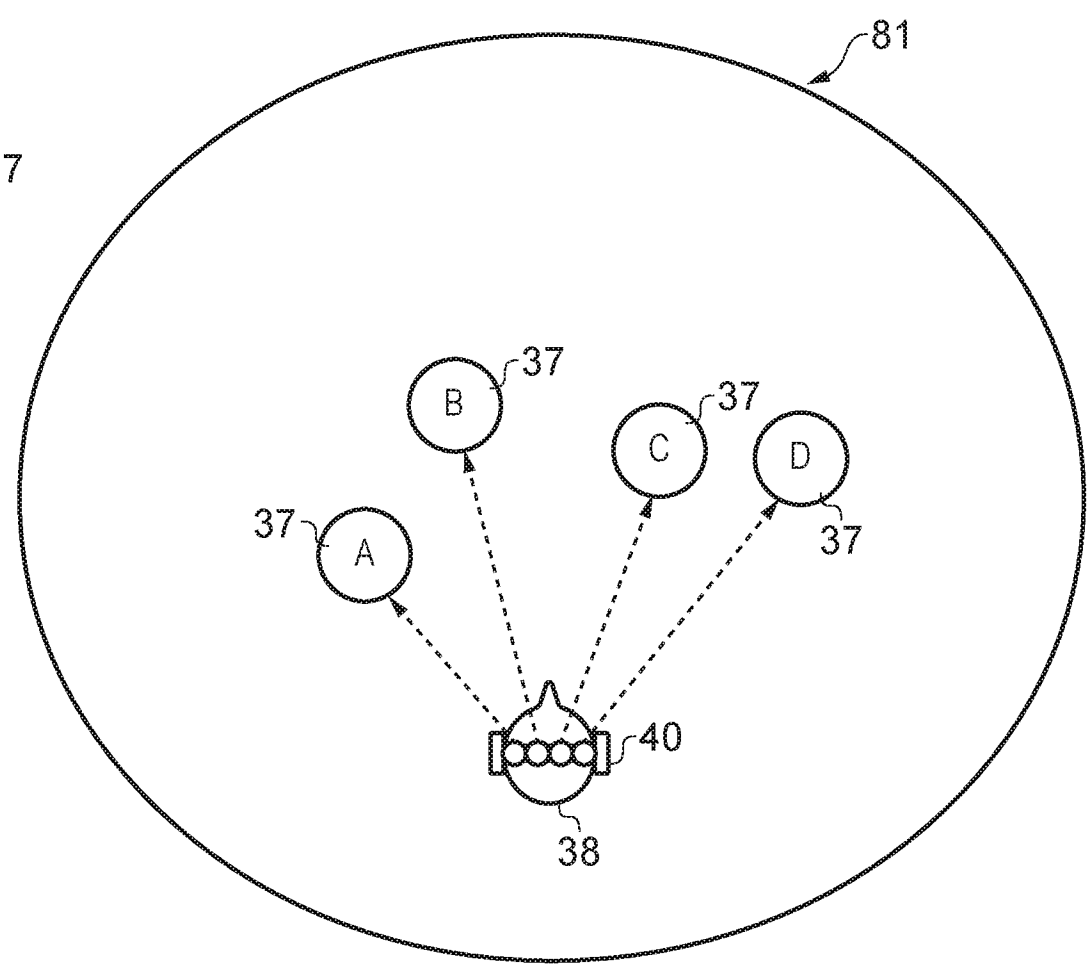
FIGS. 8A to 8B illustrate a system providing a fourth type of perspective mediated content.
Figure 8A:
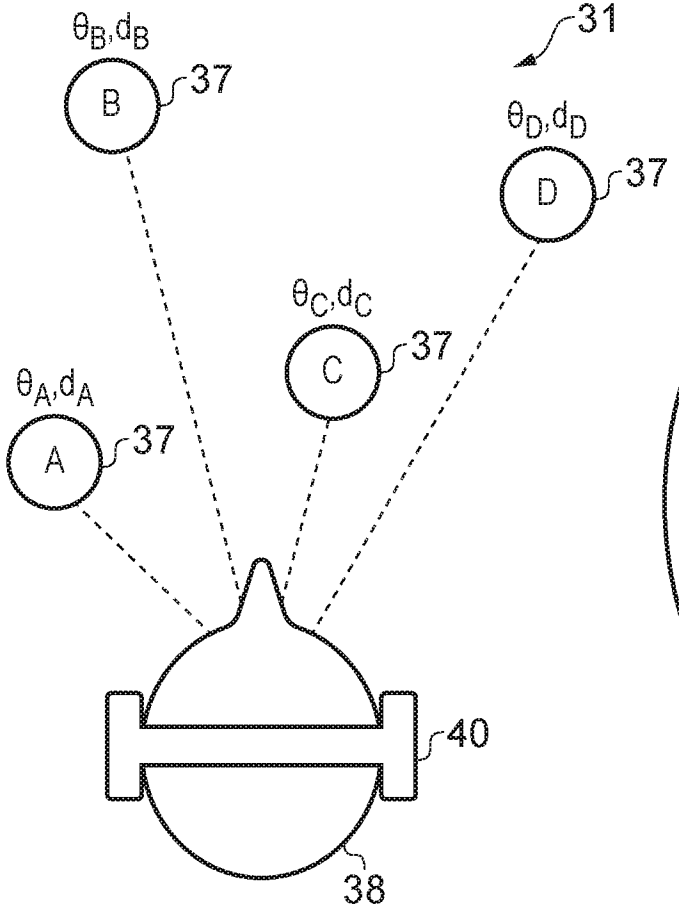

FIGS. 8A and 8B illustrate an example in which perspective mediated content has become available for a larger audio space 31. FIG. 8A shows the real audio space 31 that has been captured by one or more capturing devices and FIG. 8B shows how this could be represented to the user 38 of the rendering device 40.

In the example of FIGS. 8A and 8B the audio scene 31 is captured so that the apparatus 1 can determine the angles θ for each of the audio objects 37A, 37B, 37C and 37D and also the distance between the audio objects 37A, 37B, 37C and 37D and the listening position of the user 38. When the apparatus 1 is creating the perspective mediated content this may enable both the direction of arrival and the distance between the user 38 and the audio object 37A, 37B, 37C and 37D to be determined for each of the audio objects 37A, 37B, 37C and 37D. This may enable perspective mediated content to be created in which the angular position and the relative distance of each of the audio objects 37A, 37B, 37C and 37D can be recreated. The audio scene 31 in FIG. 8A may be similar to the audio scene as shown in FIG. 7A. In the example of FIG. 8A the capturing devices 35 captured the audio content to cover a larger audio space 31.

FIG. 8B represents the audio content being rendered to the user 38 of the rendering device 40. This shows that the audio objects 37A, 37B, 37C and 37D are rendered so that the user 38 can perceive the different angular positions of each of the audio objects 37A, 37B, 37C and 37D and can also move within a virtual audio space 81.

The virtual audio space 81 is indicated by the grey area in FIG. 8B. In the example of FIG. 8B the virtual audio space 81 comprises an oval shaped area similar to the virtual audio space shown in FIG. 7B. However, in the example of FIG. 8B the virtual audio space 81 covers a larger volume. This may enable the user 38 to move for larger distances while enabling the perspective mediated content to be rendered.

When the perspective mediated content with the larger virtual audio space 81 as shown in FIGS. 8A and 8B becomes available a notification could be added to the content being provided to the rendering device 40 to indicate that the volume for which the perspective mediated content is available has increased.

Figure 9:
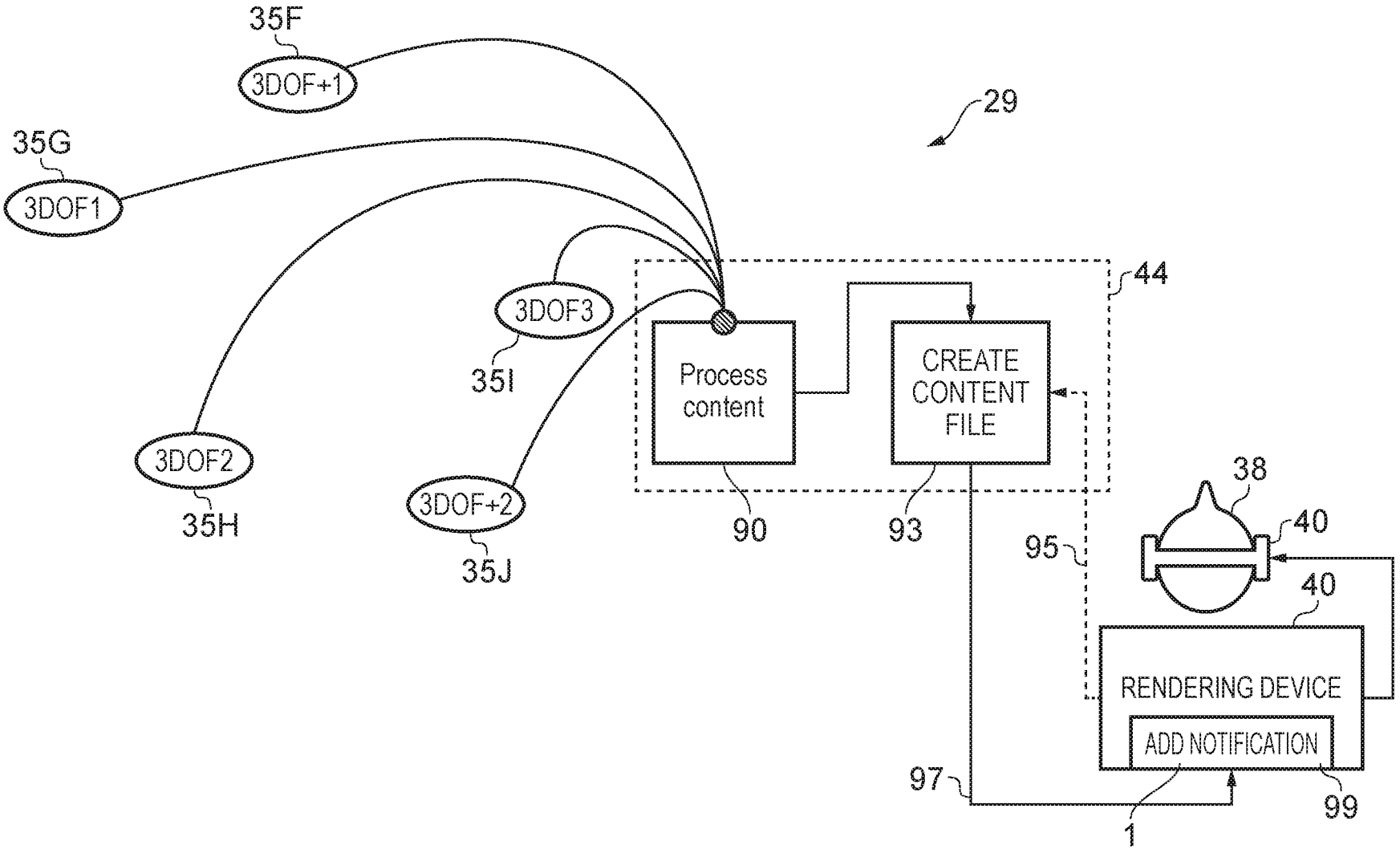
FIG. 9 illustrates another example system.

FIG. 9 illustrates another example system 29 in which different types of perspective mediated content are available. The example system 29 of FIG. 9 comprises a plurality of capturing devices 35F, 35G, 35H, 35I, 35J, a server 44 and at least one rendering device 40. An apparatus 1 for adding a notification indicative of the type of perspective mediated content available may be provided within the rendering device 40. In other examples the apparatus 1 could be provided within the server 44 or within any other suitable device within the system 29.

In the example system 29 of FIG. 9 the capturing devices 35F, 35G, 35H, 35I, 35J, may comprise image capturing devices. The image capturing devices may be arranged to capture video images or any other suitable type of images. The image capturing device may also be arranged to capture audio corresponding to the captured images.

The system 29 of FIG. 9 comprises a plurality of capturing devices 35F, 35G, 35H, 35I, 35J. Different capturing devices 35F, 35G, 35H, 35I, 35J within the plurality of capturing devices 35F, 35G, 35H, 35I, 35J are arranged to capture different types of perspective mediated content. The first capturing device 35F is arranged to capture perspective mediated content having three degrees of freedom plus, the second capturing device 35G is arranged to capture perspective mediated content having three degrees of freedom, the third capturing device 35H is arranged to capture perspective mediated content having three degrees of freedom, the fourth capturing device 35I is arranged to capture perspective mediated content having three degrees of freedom and the fifth capturing device 35J is arranged to capture perspective mediated content having three degrees of freedom plus. Other numbers and arrangements of the capturing devices 35F, 35G, 35H, 35I, 35J may be used in other examples of the disclosure.

The content captured by the plurality of capturing devices 35F, 35G, 35H, 35I, 35J is provided to a server 44. Once the server 44 has received the content from the plurality of capturing devices 35F, 35G, 35H, 35I, 35J the server 44 may perform the method as shown in FIG. 9. At block 90 the server 44 processes the content. The processing of the captured content may comprise synchronising the content captured by the different capturing devices 35F, 35G, 35H, 35I, 35J and/or any other suitable type of processing.

Once the captured content has been processed then, at block 93, the server creates a content file comprising the perspective mediated content. In some examples the server 44 may create a plurality of different content files where different content files comprise different types of perspective mediated content. In some examples the content file may comprise metadata which indicates that the content is perspective mediated content. The metadata may indicate the number of degrees of freedom that the use has within the perspective mediated content, for example it may indicate whether the user has three degrees of freedom or six degrees of freedom. In some examples it may indicate the size of the volume in which the perspective mediated content is available. For example it, may indicate the virtual space in which the perspective mediated content is available. In such examples the metadata may be used to determine whether or not perspective mediated content is available. In some examples the metadata may indicate the period of time for which the perspective mediated content has been captured.

The content file could be created simultaneously to the capturing of the content. This may enable live streaming of the perspective mediated content. In other examples the content file could be created at a later point in time. This may enable the perspective mediated content to be stored for rendering at a later point in time.

At block 95 an input selecting a content file is received by the server 44. The input may be received in response to an input made by the user 38 via the rendering device 40. The input could be selecting a particular content file, selecting content captured by a particular capturing device 35 or any other suitable type of selection.

In the example of FIG. 9 the user could select to render content captured by a particular capturing device 35. For example a user 38 could select to switch between content being captured by the first capturing device 35F and content captured by the second capturing device 35G.

In response to the input 95 the selected content is provided, at block 97, from the server to the rendering device 40. At block 99 an apparatus 1 within the rendering device 40 determines the type of content that is available. If the type of perspective mediated content that is available has changed then the apparatus 1 will add the audio notification indicative that the type of perspective mediated content that is available has changed.

For instance, in the example of FIG. 9 when the user 38 switches between content being captured by the first capturing device 35F and content captured by the second capturing device 35G this will change the type perspective mediated content that is available for three degrees of freedom plus to three degrees of freedom. The apparatus 1 may detect this change using metadata within the respective content files. The audio notification that is added to the content may provide an indication that the degrees of freedom available has been reduced by the switch to the new content file. In response to the audio notification the user 38 could decide to continue rendering the content captured by the second capturing device 35G or could select a different content file.

Examples of the disclosure therefore provide for an efficient method of providing notifications to a user 38 of a rendering device 40 that perspective mediated content has become available. This notification can be provided audibly and so does not require any visual user interface to be provided. This means that, in examples where the user 38 is viewing visual content, the visual content will not be obscured by any icons or other notifications that the user 38 could find irritating.

The notification that is added to the content could also provide an indication of the type of perspective mediated content available and/or the size of the perspective mediated content available. This may provide additional information to the user and may help the user 38 of the rendering device 40 to decide whether or not they wish to start using the perspective mediated content.

Adding the notification to the content that is provided to the rendering device also provides the advantage that there is no need to provide any additional messages between the apparatus 1 and the rendering device 40. This means that the notification that the perspective mediated content is available can be provided to the user 38 as soon as the perspective mediated content becomes available. This reduces any latency in the notification being provided to the user 38.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus comprising:

circuitry configured to determine that perspective mediated content is available within content provided to a rendering device, wherein the perspective mediated content comprises content which has been captured via a plurality of spatially distributed devices within a three dimensional space to enable different audio scenes and visual scenes to be rendered via the rendering device, wherein the audio scenes and visual scenes that are rendered are dependent upon a position of a user of the rendering device; and circuitry configured to add a notification to the content indicative that perspective mediated content is available;

wherein the notification comprises a spatial audio effect that is to provide a change in spatialisation of rendered content, wherein the change in spatialisation of the rendered content provides an indication of a change in availability of the perspective mediated content.

2. An apparatus as claimed in claim 1 wherein spatial audio effects of the notification are temporarily added to the content.

3. An apparatus as claimed in claim 1 wherein the notification comprises the application of an artificial audio object to the content provided to the rendering device in response to detecting that the content does not comprise audio content.

4. An apparatus as claimed in claim 1 wherein the change in spatialisation comprises one or more of, ambient noise, and reverberation.

5. An apparatus as claimed in claim 1 wherein the change in spatialisation comprises applying a room impulse response to the content.

6. An apparatus as claimed in claim 5 wherein the room impulse response that is applied is independent of a room in which the perspective mediated content was captured and a room in which the content is to be rendered.

7. An apparatus as claimed in claim 1 wherein the change in spatialisation causes the content to be rendered in a manner that does not correlate with the audio scene corresponding to the user's position.

8. An apparatus as claimed in claim 1 wherein the notification added to the content comprises the addition of reverberation to the content to create the audio effect that one or more audio objects are moving within the three dimensional space.

9. An apparatus as claimed in claim 1 wherein the perspective mediated content comprises audio content.

10. A content rendering device comprising an apparatus as claimed in claim 1 and circuitry configured to render the perspective mediated content.

11. A content capturing device comprising an apparatus as claimed in claim 1 and circuitry configured to capture the perspective mediated content.

12. A method comprising:

determining that perspective mediated content is available within content provided to a rendering device, wherein the perspective mediated content comprises content which has been captured via a plurality of spatially distributed devices within a three dimensional space to enable different audio scenes and visual scenes to be rendered via the rendering device, wherein the audio scenes and visual scenes that are rendered are dependent upon a position of a user of the rendering device; and adding a notification to the content indicative that perspective mediated content is available;

wherein the notification comprises a spatial audio effect that is to provide a change in spatialisation of rendered content, wherein the change in spatialisation of the rendered content provides an indication of a change in availability of the perspective mediated content.

13. A method as claimed in claim 12 wherein spatial audio effect of the notification is temporarily added to the rendered content.

14. A method as claimed in claim 12 wherein the change in spatialisation comprises one or more of, ambient noise, and reverberation.

15. A method as claimed in claim 12 wherein the change in spatialisation comprises applying a room impulse response to the content.

16. A non-transitory computer-readable storage medium comprising computer program instructions that, when executed by processing circuitry, cause:

determining that perspective mediated content is available within content provided to a rendering device, wherein the perspective mediated content comprises content which has been captured via a plurality of spatially distributed devices within a three dimensional space to enable different audio scenes and visual scenes to be rendered via the rendering device, wherein the audio scenes and visual scenes that are rendered are dependent upon a position of a user of the rendering device; and adding a notification to the content indicative that perspective mediated content is available;

wherein the notification comprises a spatial audio effect that is to provide a change in spatialisation of rendered content wherein the change in spatialisation of the rendered content provides an indication of a change in availability of the perspective mediated content.

17. A non-transitory computer-readable storage medium as claimed in claim 16 wherein spatial audio effect of the notification is temporarily added to the rendered content.

18. An apparatus as claimed in claim 1 wherein the change in spatialisation of the rendered content indicates a change in the availability of a new type of perspective mediated content.

19. An apparatus as claimed in claim 1 wherein the notification comprises the application of an artificial audio object to the content provided to the rendering device in response to detecting that the content comprises audio content below a threshold volume level.

20. An apparatus as claimed in claim 1 wherein the spatial audio effect comprises causing audio objects to move away from the user to provide an effect that an audio space is increasing in size.

* * * * *